US005381340A

United States Patent [19]

Ueda et al.

[11] Patent Number: 5,381,340

[45] Date of Patent: Jan. 10, 1995

[54] QUALITY CONTROL SYSTEM IN A SPINNING MILL

[75] Inventors: Yutaka Ueda, Nara; Keizo Ohori, Kyoto; Tsuneo Shimizu, Anjo; Shoji Mizutani, Toyohashi, all of Japan

[73] Assignees: Murata Kikai Kabushiki Kaisha, Kyoto; Kondo Cotton Spinning Co., Ltd., Nagoya, both of Japan

[21] Appl. No.: 128,259

[22] Filed: Sep. 28, 1993

Related U.S. Application Data

[63] Continuation of Ser. No. 689,370, Apr. 22, 1991, abandoned.

[30] Foreign Application Priority Data

Apr. 24, 1990 [JP] Japan ..... 2-106510

[51] Int. Cl.[6] ..... G06F 15/46

[52] U.S. Cl. ..... 364/470; 57/264; 364/132; 364/552

[58] Field of Search ..... 364/470, 138, 139, 550, 364/551.01, 552, 554, 507, 468, 131–134; 73/159, 160; 57/264, 265, 362

[56] References Cited

U.S. PATENT DOCUMENTS

| | | | |
|---|---|---|---|
| 3,922,642 | 11/1975 | Tooka | 364/470 |
| 4,408,447 | 10/1983 | Sloupensky et al. | 364/470 X |
| 4,571,685 | 2/1986 | Kamoshida | 364/468 |
| 4,709,337 | 11/1987 | Knapp et al. | 364/468 |
| 4,774,673 | 9/1988 | Aemmer | 364/470 |
| 4,835,699 | 5/1989 | Mallard | 364/470 |
| 4,944,033 | 7/1990 | Erni | 364/470 |
| 4,998,206 | 3/1991 | Jones et al. | 364/132 X |
| 5,046,013 | 9/1991 | Ueda et al. | 364/470 |
| 5,119,308 | 6/1992 | Samoto | 364/470 |
| 5,124,928 | 6/1992 | Aemmer | 364/470 |
| 5,150,288 | 9/1992 | Imai et al. | 364/468 X |
| 5,166,874 | 11/1992 | Nomaru et al. | 364/468 X |

*Primary Examiner*—Joseph Ruggiero

*Attorney, Agent, or Firm*—Spensley Horn Jubas & Lubitz

[57] ABSTRACT

A quality control system in a material processing mill. The mill may include several different processing machines for performing several different processing steps to produce several different intermediate products. Each processing machine is provided with a sub-processor for monitoring production information associated with the processing machine and quality information associated with the intermediate product produced by the processing machine. The quality and production information from the various sub-processors are directed to a main processor, which records a history of the processing of the various intermediate products.

8 Claims, 8 Drawing Sheets

FIG. 2

| | STEP | FRAME NUMBER | MAIN NECESSARY INFORMATION | |
|---|---|---|---|---|
| | | | PRODUCTION | QUALITY |
| 1 | RAW COTTON WAREHOUSE | 1 | ACCESS TO WAREHOUSE | COARSENESS, LENGTH, COLOR AND STRENGTH OF FIBER |
| 2 | MIXING AND BLOWING | 1 2 | PRODUCTION AMOUNT | METAL MIXED |
| 3 | CARD | 1 2 3 39 40 | EFFICIENCY OF PRODUCTION AMOUNT | WEIGHT PER UNIT LENGTH UNNEVENNESS OF COARSENESS |
| 4 | SLIVER LAP | 1 2 3 4 5 | EFFICIENCY OF PRODUCTION AMOUNT | WEIGHT |
| 5 | RIBBON LAP | 1 2 3 4 5 | EFFICIENCY OF PRODUCTION AMOUNT | WEIGHT |
| 6 | COMBER | 1 2 3 39 40 | EFFICIENCY OF PRODUCTION AMOUNT | WEIGHT CONTROL |
| 7 | DRAWING I | 1 2 3 4 5 6 7 8 9 | EFFICIENCY OF PRODUCTION AMOUNT | |
| 8 | DRAWING II | 1 2 3 4 5 6 7 8 9 | EFFICIENCY OF PRODUCTION AMOUNT | UNNEVENNESS OF COARSENESS |
| 9 | ROVING | 1 2 3 14 15 | EFFICIENCY OF PRODUCTION AMOUNT NUMBER OF TIMES OF BREAKAGES | |
| 10 | SPINNING | 1 2 3 30 40 | EFFICIENCY OF PRODUCTION AMOUNT NUMBER OF TIMES OF BREAKAGES | PERIODICAL UNNEVENNESS OF COARSENESS OF YARN WHICH IS UNEVEN COUNT, AND DEFECTS |
| 11 | WIDER | 1 2 3 30 40 | EFFICIENCY OF PRODUCTION AMOUNT NUMBER OF TIMES OF BREAKAGES NUMBER OF PACKAGES | KNOTTING AND STRENGTH NUMBER OF TIMES OF OCCURRENCES OF ABNORMALITY DEFECTIVE PACKAGE |
| 12 | INSPECTION AND PACKING | 1 | QUANTITY ACHIEVEMENT RATE OF PRO-DUCTION | MILL RECORD |
| 13 | WAREHOUSE SHIPMENT | 1 | STOCK CONTROL | STOCK |

| | MIXING AND BLOWING | CARD | ------ | | WINDER |
|---|---|---|---|---|---|
| A | | | | | |
| B | | | | | |
| C | | | | | |
| D | | | | | |

QUALITY CONTROL SYSTEM IN A SPINNING MILL

This is a continuation of application Ser. No. 07/689,370 filed on Apr. 22, 1991, now abandoned.

FIELD OF THE INVENTION

The present invention relates to a quality control system in a spinning mill for producing packages via at least one or more of the steps of mixing and blowing, combing, drawing, roving, fine spinning and winding, or via at least one or more of the steps of mixing and blowing, combing, drawing, open end or air jet spinning.

RELATED ART STATEMENT

Generally, in a spinning mill, yarns are produced via various steps such as mixing and blowing, combining, drawing, roving, fine spinning, rewinding and the like after the reception of raw cotton. In the processing steps, fiber machineries are used exclusively for the respective steps, for example, such as a mixing and blowing machine, a combing machine, a drawing machine, a roving machine, a fine spinning machine, a winder, a doubler, a twisting machine and the like are used. The produced yarn products are shipped in the form of packages from the spinning mill and then delivered to post-steps outside the mill, for example, steps for woven fabrics, dyeing and the like.

In the past, in the spinning mill, the control of yarn quality is one of the more important matters, and various quality inspections from the reception and inspection of the raw cotton to the inspection of the final products are carried out, most of which inspections are conducted outside the line by sampling, checking in the final stage in the respective processing steps, or post-processing after the products have been produced. In addition, the pursuit of a cause for unacceptance by checking is carried out within the respective processing steps.

The relationship between the quality inspection and the production control is that products in the respective processing steps, that is, yarn-like materials such as lap, sliver or the like and yarns are subjected to sample checking, after which only acceptable products are selected, whereby the production quantity and working state are controlled.

However, by making the sample check at every step, the quality of yarns or yarn-like materials produced in that step is found only later, and a real time judgement cannot be made. Yarns or yarn-like materials which are defective in quality are continuously produced even during checking. Accordingly, it is necessary to pursue the cause of the defect, and to promptly take measures, such as the stoppage of a defective machine.

However, in the processing steps in the spinning mill, two or more fiber machines may be used in the same step, and one frame often comprises a number of spindles. That is, fibers are repeatedly branched or merged while the fibers are sent from one step to the next. Even in the case where the result of a sample check is judged to be defective, it is difficult to specify the step which is actually in an abnormal condition out of the number of steps that occur between the reception of raw cotton to shipment. Moreover, it was impossible to specify a machine which is in trouble or defective out of all of the frames or spindles. Therefore, the pursuit of the cause for defectiveness by checking is compelled to the interior of the respective processing step, resulting in the risk that a great quantity of final yarn products of poor quality are produced.

Moreover, in the case where final products are produced overlooking the state where the yarn quality is poor, it is extremely difficult to find that said yarn is poor in quality from the characteristics of yarns. Such discovery is often very delayed such that the poor quality of yarn is found only outside the spinning mill.

Even in a case where products of poor quality can be found, it was not always possible to pursue the cause of when and where the problem occurred back to the processing steps and the fiber machines within the spinning mill. The reasons for this are as follows:

(1) There are many machines provided in the same step. Through which machine the product has passed is obscure.

(2) Many steps are involved from the charging of raw cotton to shipment, and unspecified days and time may have elapsed.

(3) It is often the case that when a problem is found, another product is already flowing through the same step.

From the foregoing, the delivery of products and necessary number of production in the production plan are affected by the conventional way of processing.

OBJECT AND SUMMARY OF THE INVENTION

It is an object of the present invention to provide a quality control system in a spinning mill which, in the case where a product of poor quality is found, can grasp the previous record of the product in the spinning mill and can pursue the cause of defectiveness.

The present invention provides, in a spinning mill for producing packages via at least one or more of the steps of mixing and blowing, combing, drawing, roving, fine spinning and winding, or via at least one or more of the steps of mixing and blowing, combining, drawing, open end or air jet spinning, a quality control system in a spinning mill wherein in applying discrimination symbols to respective steps, frames and spindles and carrying out doffing at one step to supply products to next step, the numbers of frames or spindles for the doffing, the numbers of doffing or lots, and the numbers of frames or spindles for the destination for products to be supplied may be grasped by a sub-processor, these numbers together with general quality information and production information of the respective steps are collected and stored in a main processor, and records of the places and time for intermediate products halfway between steps or of final products which have been passed can be grasped.

In the main processor are collected, together with general quality information and production information, frame numbers or spindle numbers on both the doffing side and the supply side as place information and the doffing numbers or the lot numbers as time information, and the place and time records for the final products which have been passed therethrough are grasped. Therefore, in the event that a product of poor quality is found, the cause thereof can be pursued back to a number of steps, frames and spindles including the reception of raw cotton to shipment.

BRIEF DESCRIPTION OF THE DRAWINGS

FIG. 2 illustrates the number of frames in steps and necessary information;

DETAILED DESCRIPTION OF PREFERRED EMBODIMENT

Figure 1:
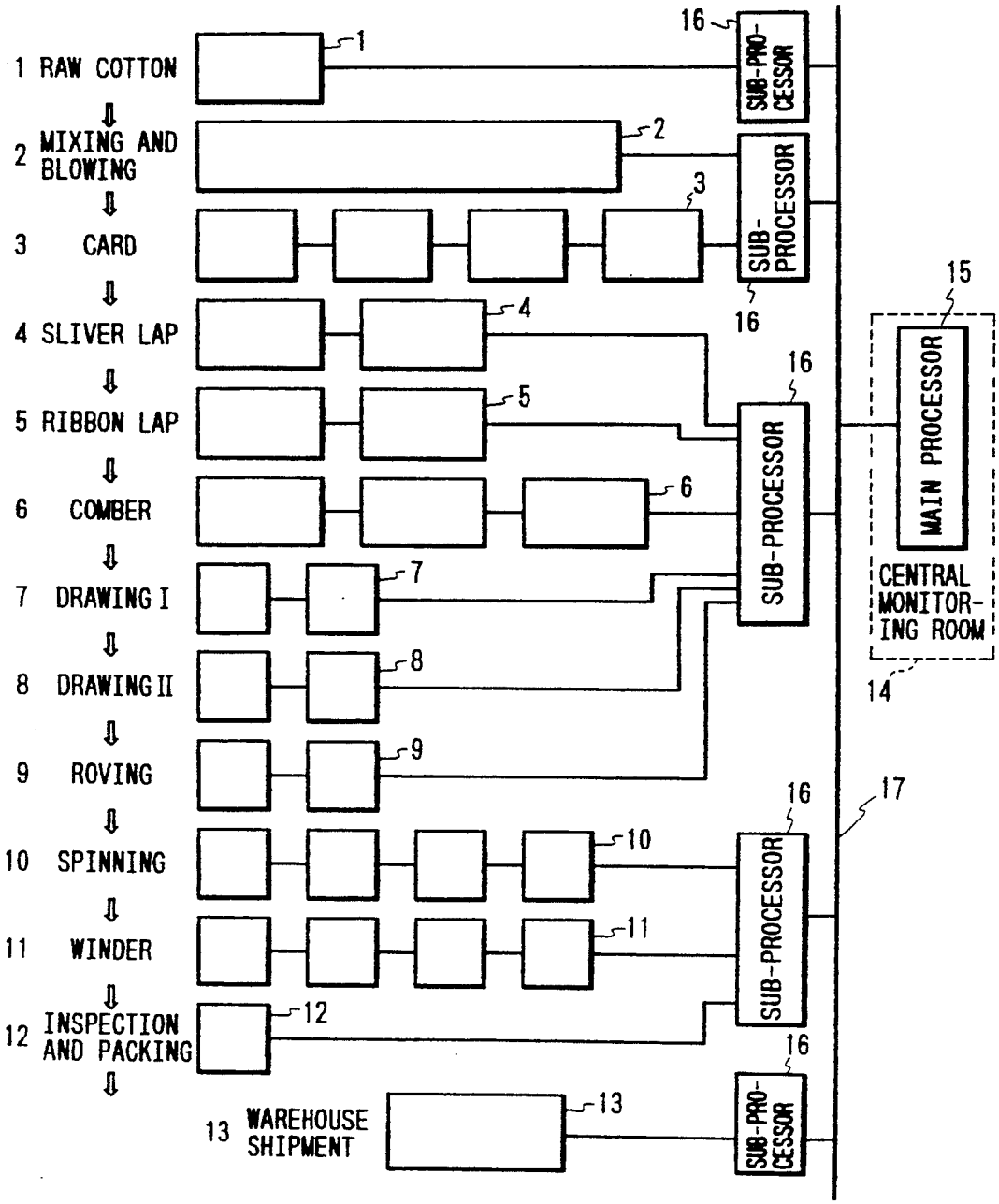
FIG. 1 is a block diagram of a yarn quality control system according to an embodiment of the present invention.

Embodiments shown in the drawings will be described hereinafter.

FIG. 1 shows an example of a whole quality production control system in a spinning mill. In this figure, reference numeral 1 designates a raw cotton warehouse; 2 a mixing and blowing machine; 3 a card; 4 and 5 a sliver lap machine and a ribbon lap machine as comber preparation machines; 6 a comber; 7 a first drawing machine I; 8 a second drawing machine II; 9 a roving machine; 10 a fine spinning machine; 11 a winder; 12 an inspection and packing station; and 13 a warehouse shipment station. These steps correspond to step numbers "1" to "13" as shown in FIG. 2.

In the mixing and blowing machine 2, loose stock not making a lap is distributed and supplied to dozens of cards 3. 5 to 8 cards are arranged in a row. Delivered card slivers are subjected to doubling in the sliver lap machine 4 and the ribbon lap machine 5, and are supplied to the first drawing machine I via the comber 6 as necessary.

In a desk portion of the first drawing machine I, there are 10 cans or more placed on an automatic moving device. Slivers from the first drawing are received into a coiler can, and a full can is measured. A long period variation of slivers is controlled. Upon termination of measurement, the full cans are successively transferred to the second drawing machine II for further doubling and then supplied to the second drawing machine II. When the sliver in the feed can is emptied, an apparatus for simultaneously moving full cans is actuated to extrude an empty can onto the conveyor and at the same time extrude a full can below a creel of the second drawing machine II.

Next, in the roving machine 9, yarn is drawn to a coarseness capable of providing a yarn having the desired coarseness, and the yarn is formed into a bobbin of roving and applied to a ring fine spinning machine 10. The ring fine spinning machine 10 is provided to draft a coarse yarn to apply a twist thereto to form a yarn, which is wound on a bobbin. This fine spun yarn is rewound in length for a few bobbins into one package (normally a cheese) by the winder 11 and then sent to the inspection and packing station 12, where the package is inspected and shipped as a final product.

A central monitoring room 14 is provided with a main processor 15 and constitutes together with sub-processors 16 in the aforesaid steps a LAN (Local Area Network) connected by a transmission line 17 formed of optical fibers. Various quality information and production information are inputted into the main processor 15 through the sub-processors 16 from the aforementioned steps to control the yarn quality of the final products and to control production.

Production information and quality information to be inputted into the main processor 15 may include those shown on the right side of FIG. 2. In addition to the above, in the main processor are collected, as quality control information, place and time "record information" indicating when material or an intermediate product is transferred from one step to the other, that is, "place information" representative of from which frame or spindle the material is branched or merged to which frame or spindle and "time information" representative of the time when the material is branched or merged and worked. The main processor specifies individual final products to grasp the record of the products which have been passed in accordance with a series of place and time "record information". Characters capable of displaying the grasped contents of the record within the spinning mill are printed on a label by a printer, and these labels are attached to surfaces of packages as individual final products.

When the main processor 15 detects a final product which is defective in yarn quality, the main processor pursues the cause of the defect to the step and the frames that are in trouble in accordance with the record information within the mill of said product, and displays the estimated cause of the defect on a monitor screen to let a production manager know it.

Therefore, it is important for the "place information" as to where the product has been passed to grasp the frame numbers or the spindle numbers in the steps. It is further important for the "time information" as to when the product has been passed to grasp the doffing numbers or the lot numbers in the steps.

(1) Back Numbers of Steps, Frames and Spindles

FIG. 2 merely illustrates a change of numbers of frames from the mixing and blowing to the automatic winder but one frame is constituted by a plurality of spindles depending on steps. For example, the drawing II is composed of ten frames numbered 1–10, with each frame comprising two spindles, and the roving step is composed of fifteen frames numbered 1–15, with each frame comprising 120 spindles. In such steps, the spindle numbers in addition to the aforementioned frame numbers are applied.

In short, to all steps, frames and spindles are applied discrimination symbols capable of specifying one of these, in this example, back numbers. By these back numbers, computer processing becomes easy, and an operator can easily discriminate the place. The back number is indicated as "0908110", for example, in case of roving machine, No. 8 frame and 110th spindle.

(2) Collection of Record Information of the Products

Even materials (for example, kinds of articles) of the same lot, a plurality of materials are supplied, with a single body such as a lap, a sliver, a can, a roving bobbin, a fine spinning bobbin, a package and the like or a group of these as a "carrying unit", to the frame of the same number in the same step, or the material in the form divided into a plurality of portions are produced while being subjected to doffing.

Figure 3:
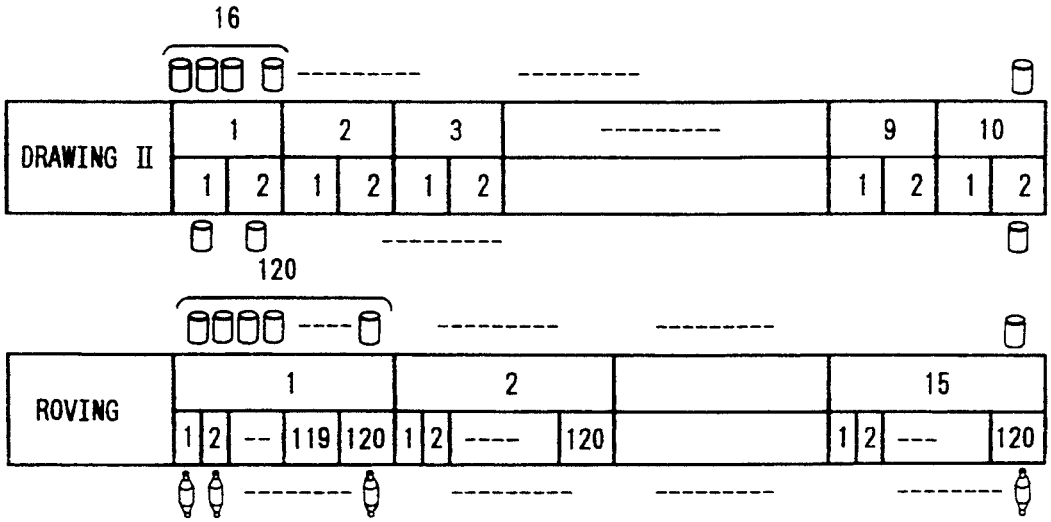
FIGS. 3 and 4 illustrate a movement per carrying unit in which one frame comprises a plurality of spindles.
Figure 4:
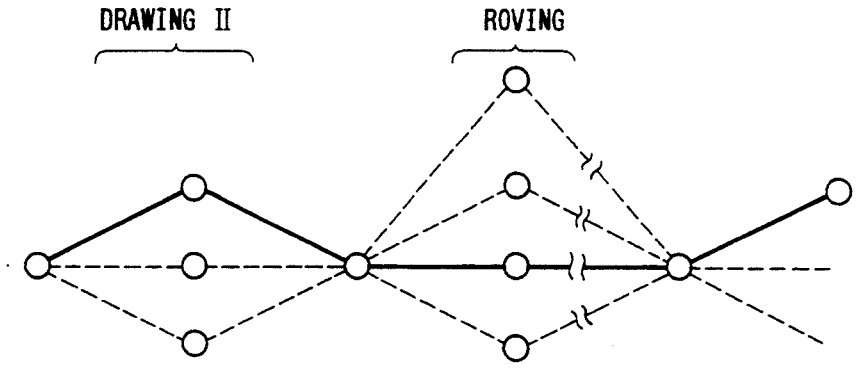

For example, in the case of the drawing II—roving shown in FIGS. 3 and 4, two cans are simultaneously doffed (discharged) from No. 1 frame to No. 10 frame of the drawing II, and the discharged cans 120 are supplied to a single roving machine. In the roving machine, about 15 roving bobbins are doffed (produced) by one can.

Figures 5, 6:
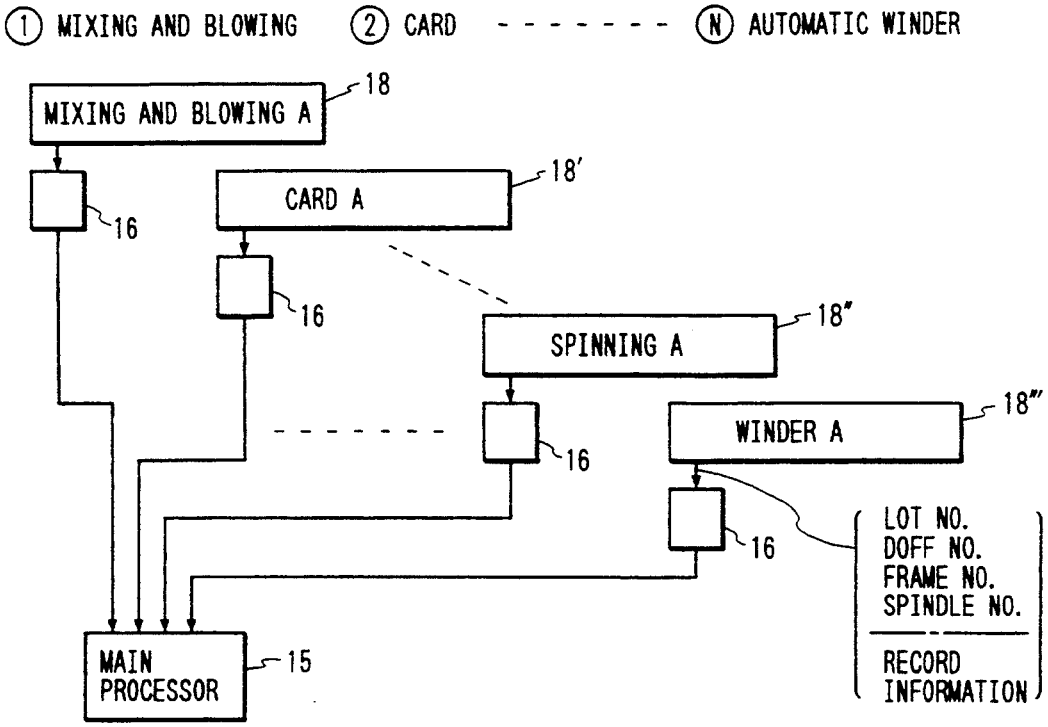
FIG. 5 illustrates the structure for grasping the movement per carrying unit.
FIG. 6 is an explanatory view of the form of information to be collected.

In view of the foregoing, in order to clearly grasp the relationship as described above, sub-processors 16 are provided at every step or at every group of steps as needed, as shown in FIG. 5, to grasp "Which doffing from one frame or spindle in the previous step is supplied to which frame or spindle in the next step, and for which doffing it is used.", and the grasped content is stored in a memory of the main processor 15. In this case, in the steps capable of being connected in a completely unmanned manner by the automatic carrying and robot, the destinations of the products are inputted into the sub-processor 16 by said connecting device, and other information is grasped timely.

Alternatively, memory media capable of reading and writing magnetically or optically, for example, such as a magnetic film or ID card are attached to the can, bobbin, package or the like as the "carrying unit" so that "doffing number or lot number" of the corresponding frame and the corresponding "frame number or spindle number" are written every frame in the step by a read/-write device 18 (see FIG. 5) so as to read it by the read/write device 18 in the corresponding frame in the next step. In this case, the place and time information can be controlled irrespective of the automatic carrying or manual carrying.

Anyway, the place and time information grasped by the sub-processors 16 along with general various quality information and production information are delivered to the transmission line 17 and collected in the main processor 15.

Accordingly, in a case where the material being handle is "A", even if the style of the carrying unit is changed into a can or bobbin as the material moves to the mixing and blowing machine, the card, . . . the fine spinning machine and winder, the "doffing or lot number" and the "frame or spindle number" to which they belong are all collected and controlled in the carrying unit as indicated by the lateral line in the Table of FIG. 6. The same is true for other materials B, C, D . . .

The case of the drawing II—roving shown in FIG. 3 will be described in detail.

Two cans are simultaneously discharged every time from each of the frames 1–10 of the drawing II. In this case, "Which frame, which spindle and what order of doffing the can is" is separately controlled by the sub-processor 16. "To which frame of the roving machine and what order the two discharged cans are supplied" is also recorded.

When a supply of 120 is accumulated and the cans charged to the roving machine are empty, an empty can is replaced by a full can. In the full can supplied to the roving machine, about 15 winding bobbins (roving) are produced by one can.

When the full can has been charged and yarn engaging operation starts, the "operation start time" and one "number of times of doffing" for one winding bobbin are recorded, and "To which frame and which spindle in next step" the one subjected to doffing is supplied is recorded.

With respect to all steps, recording is made and computer control is accomplished in a manner similar to that as described above.

On the other hand, with respect to general quality information for the aforementioned production control, "frame number", "measuring position" and "measuring time" are described according to the results of measurement separately conducted. Production information is also described.

That is, "frame number of spindle number" as place information representative from where it comes from, and "doffing number or lot number" representative of time information when it comes are added to the production quality control information and controlled whereby a flow of products and a flow of information are simultaneously grasped.

In this way, record information within the mill of each final product is stored and maintained in the memory of the main processor 15.

(3) Quality Inspection and Processing

Next, in the inspection and packing station 10, in the case where a final product of poor yarn quality is detected, the main processor 15 clears up to which step and which frame are normal in accordance with the record information within the mill of the product stored in carrying unit and cleared and other general yarn quality information to estimate a place of trouble or the like, the result of which is displayed on a monitoring screen to let a production manager know it. The main processor 15 of the central monitoring room 14 causes the printer to print visible characters to the effect that the yarn quality of the final product is defective along with the record within the mill on a label, and the label is attached to the final product.

(4) Production Information Detection Means

As shown in FIG. 2, there can be used detection means suitable for grasping the raw cotton warehouse or production amount (mixing and blowing step) or production amount, efficiency (card, comber preparation, comber, drawing I, and drawing steps), production amount, efficiency, the number of times of breakages (roving, fine spinning step) or production amount, efficiency, the number of times of breakages, the number of packages (winder step) or inspection and packing (quantity, achievement rate of production).

Specific production information detection means include a tachosensor for measuring a spinning speed, a detector for detecting doffing, a counter for counting the number of products passing through a carrying passage or the like as a carrying unit, various contacts for frames for automatically collecting data caused by various stoppages, a control for an alarm display or stoppage of frame, etc.

(5) Quality Information Detection Means

As shown in FIG. 2, there can be used detection means suitable for measurement of coarseness of fiber, length, color and strength (raw cotton warehouse) or detection of metal (mixing and blowing step) or measurement of weight per unit length (card, comber preparation, comber step) or measurement for unevenness of coarseness (drawing II step) or detection for breakages, unevenness of count, periodical unevenness of coarseness and defective yarn (fine spinning step) or detection for knotting strength of piecing, the number of times of occurrence of abnormal piecing, and defective packages (winder step).

Figure 8:
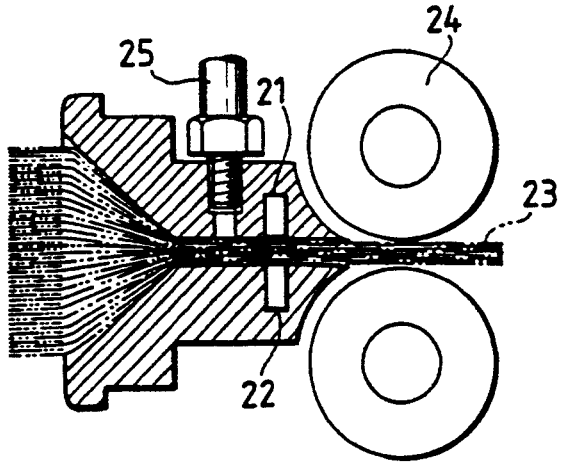
Figure 9:
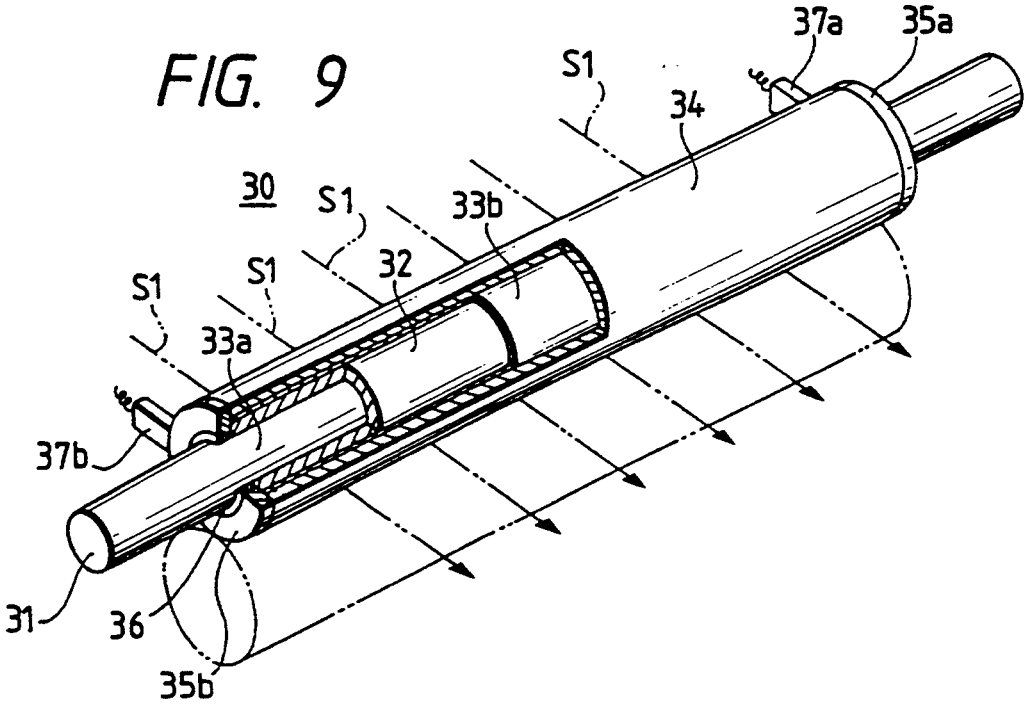

As quality information detection means, various detectors are known. Attention is invited to a fiber wave measuring unit (FIGS. 7 and 8) and a draft roller for detecting unevenness of sliver (FIG. 9) which will be described hereinafter.

Figure 7:
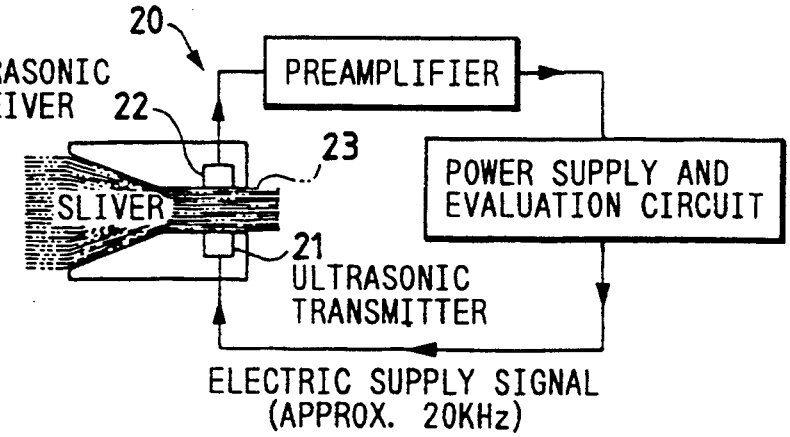
FIGS. 7 to 9 illustrate means for detecting quality information.

A fiber wave measuring unit 20 shown in FIG. 7 is a detector comprising a ultrasonic transmitter 21 and a ultrasonic receiver 22, in which a speed of a sound wave passing through a sliver is measured to thereby measure a degree of compression of a sliver 23, and thus a sectional mass. The fiber wave measuring unit 20 has no movable part and has an extremely short measuring zone, and therefore measurement at a very high speed (up to approx. 800 m/min) can be made. This unit 20 can be incorporated together with a pneumatic measuring channel 25 in the form of a condenser trumpet placed in front of a calender roller 24 to effect dynamic measurement of sliver count. The fineness of fiber can be continuously measured directly in the manufacturing step immediately after mixing and blowing of raw cotton. Futhermore, the fiber wave measuring unit 20 is suitable for measuring variation in coarseness of a sliver of drawing, comber and card.

The draft roller for detecting unevenness of sliver in the drawing machine is disclosed in Japanese Utility Model Publication No. 1(1989)-33654. A first electrode **33*a* is provided on the surface of a shaft 31 of a draft roller 30. A conductive rubber layer 32, a second electrode 33*b* and a synthetic rubber layer 34 are coaxially and cylindrically disposed on the outer peripheral portion of the first electrode 33*a*. The conductive rubber layer 32 is subjected to pressing force and resiliently deformed through the synthetic rubber layer 34 and the second electrode 33*b* according to variation of quantity of slivers S1, S2, . . . being held and drafted by the draft roller. When the conductive rubber layer 32 is resiliently deformed, an electric resistance in a radial direction of the conductive rubber layer 32 sandwiched between the first and second electrodes 33*a* and 33*b* varies. Slip rings 35*a* and 35*b* are connected to the first and second electrodes, respectively, whereby a signal of the varied electric resistance may be removed outside through brushes 37*a* and 37*b* in sliding contact with the slip rings. Reference numeral 36 designates an insulating ring of the slip ring 35*b***.

The sub-processor 16 in each step preliminarily processes data from the aforementioned detection means as needed, so that spectrograms of slivers produced in the relative frames are computed to obtain values of unevenness every delivery, which are used as quality information.

(6) Grasp of Record Between Spinning Frame and Winder

Between the spinning frame and the winder, there occurs a phenomenon in which a yarn produced in a certain spinning frame unit is inferior in quality to that of yarn produced in the other unit so that breakages often occur in the rewinding step. There is sometimes at a loss to grasp the state where there are present many piecing places in packages wound on the side of the winder. That is, the yarn produced in the aforesaid specific spinning unit is freely rewound by any winding unit in the winder. Accordingly, bobbins doffed from a spinning unit which produces yarns of poor quality for some reason and bobbins doffed from the other normal spinning unit are supplied at random to the winder. Therefore, yarns of poor quality are sometime mixed into the packages doffed in the winder.

Accordingly, a carrying tray need be provided to pursuit a carrying route of a yarn produced in a spinning unit to grasp the spinning unit as a production origin where breakages abnormally often occurs during the rewinding in the winder, and feeds back breakage information at the winder to the spinning frame to control the spinning units of the spinning frames.

To this end, a discrimination information display member capable of writing and erasing discrimination information of bobbins is mounted on the bobbin carrying tray for individually independently supporting and carrying spinning bobbins.

Figure 10:
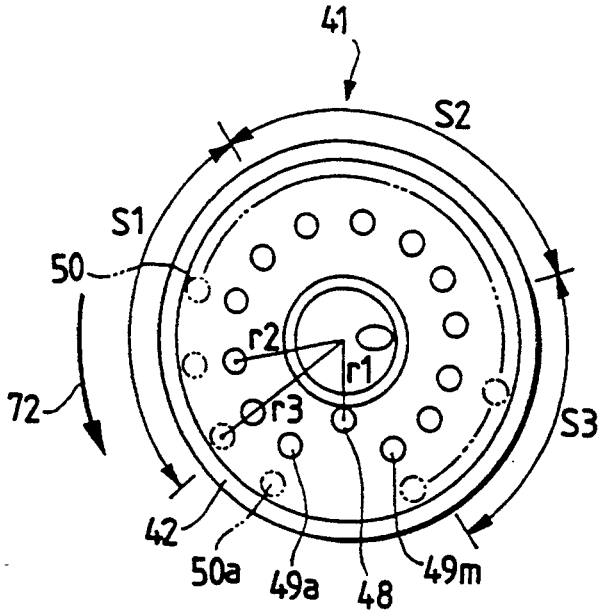
FIG. 10 is a structural view of a tray useful for collecting record information between the spinning frame and the winder.
Figure 11:
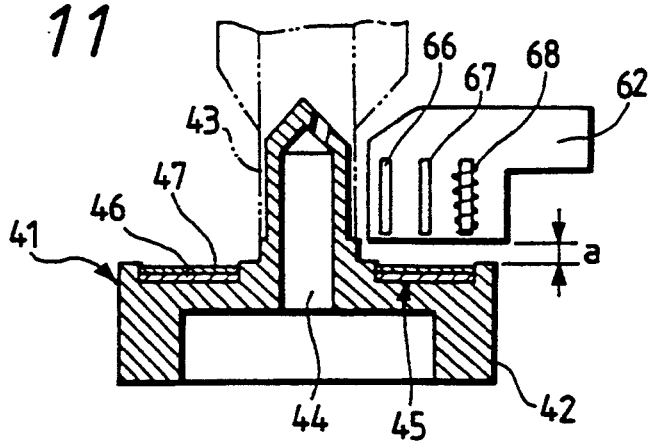
FIG. 11 is a structural view showing one example of a write head.

That is, a tray 41 shown in FIGS. 10 and 11 has a disk-like base 42 formed with pegs 3 on which bobbins are stood upright, which are integrally molded from a non-conductive member such as synthetic resins. The tray 41 is interiorly formed with an air hole 44 but may be of solid.

The disk-like base 42 of the tray 41 is formed in the upper surface thereof with an annular groove 45. An iron plate 46 for strengthening magnetization is secured into the groove 45. An discrimination information display member formed from a rubber magnet sheet 47 is secured onto the iron plate 46. The rubber magnet sheet 47 contains ferrite powder so that a magnet is moved closer thereto, suitable magnetization is attained.

In FIG. 10, the tray is formed at a circumferential portion of the radius r1 thereof with a portion 48 magnetized as a start signal for writing and reading information and at a circumferential portion of the radius r2 thereof with portions **49*a* to 49*m*** magnetized as clock signals at equal pitch indicative of write or read position of information.

Further, in the circumference of the radius r3 is formed a magnetizable portion 50 for writing discrimination information of the spinning bobbin. In the embodiments shown in FIGS. 1 and 2, a discrimination information write portion comprises four sections. Information indicative of R side and L side of the spinning frame described alter is written in a portion **50*a* corresponding to a clock 39*a***, and in other three sections S1, S2 and S3, frame numbers and spindle numbers of the spinning frames at which bobbins stood upright on the tray are produced are written.

Figure 12:
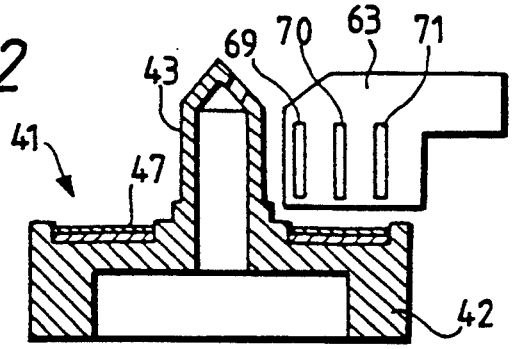
FIG. 12 is a structural view showing one example of a read head.

As shown in FIG. 11, a write head 62 comprises two magnetic sensors 66, 67 and a writing electromagnet 68 in a radial direction of a tray, and as shown in FIG. 12, a read head 63 comprises three magnetic sensors 69, 70 and 71 in a radial direction of the tray. These heads 62 and 63 are movably or fixedly mounted away by dimension a from the surface of a rubber magnet sheet 47 on the upper surface of the tray. The aforesaid dimension a is suitably about 1.5 mm. That is, the magnetic sensors 66 and 69 read a start signal 48, and the magnetic sensors 67 and 70 read clock signals 49*a*–49*m*. The magnetic sensor 71 reads discrimination information of bobbin.

Figure 13:
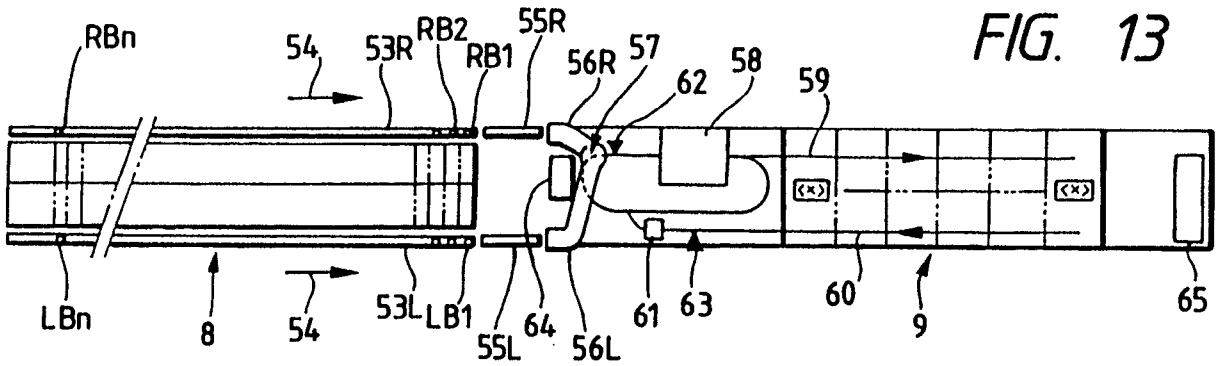
FIG. 13 is a schematic plan view showing one example of a spinning winder to which a tray is applied.

Next, one example of the bobbin carrying system by the tray is shown in FIG. 13.

In the spinning winder with the spinning frame 10 and the winder 11 directly connected thereto, spinning bobbins produced in the spinning frame 10 are simultaneously doffed and stood upright on the pegs provided at pitch intervals of the spinning spindles on left and right transport bands 53L and 53R which can be moved along the spinning spindles. Thereafter, in response to bobbin request instructions on the winder 11 side, the transport band 53R or 53L is intermittently moved in a direction of arrow 54, bobbins are transported through an inclined connecting conveyor 55R or 55L, the bobbins are then fallen into a chute 56R or 56L from the upper end of the conveyors 55R, 55L, and thence the bobbins are mounted on the tray 41 which is on standby at a bobbin supply position 57.

The tray integral with the bobbin is supplied to a yarn end preparation device 58, where a yarn end is subjected to yarn end finding to the state suitable for piecing at the winder. The yarn is then carried in a direction of arrow toward the winder 11 on the carrying passage 59.

In the winder, bobbins are supplied to the winding units while being mounted on the tray, rewound and discharged. Empty bobbins or the like discharged from the winding units into a carrying passage 60 are transferred in the state where they are integral with the tray to a bobbin removing station 61, where empty bobbins and bobbins having a remaining yarn but an extremely small amount of remaining yarn which cannot be again supplied to the winder are removed from the tray on which the bobbins are stood upright. The empty bobbins are returned to a predetermined position on the spinning frame 10 side via an empty bobbin carrying passage not shown, and the bobbins with a small amount of remaining yarn are separately discharged or stored in a box. Accordingly, the trays having passed through the bobbin removing station 61 are empty trays or trays having bobbins with a remaining yarn which can be again supplied to the winder.

The transport band 53R or 53L on the spinning frame side is rotated pitch by pitch every time an empty tray arrives at the spinning bobbin supply position 57 to supply one spinning bobbin to the emtpy tray on standby, and is again supplied to the winding unit.

The pursue of a bobbin in the case where the tray 41 of FIGS. 10 and 11 is applied, in the spinning winder, will be described hereinafter.

In case of applying the tray 41, as shown in FIG. 13, a write head 62 for writing discrimination information of a spinning bobbin stood upright on the tray is mounted on an in-carrying passage 59 of the winder 9, and a read head 63 for reading said information is mounted on an out-carrying passage 60 of the winder. Operating instructions of the heads 62 and 63 are issued by a controller 64. On the winder 11 side is installed a controller 65 housing therein a computer (a sub-processor 13) for inputting and processing various information of the winding units and information from the read head 63.

In the winder, yarn breakages are detected by a yarn breakage detection feeler provided on the winding unit and inputted into the controller 65, and the number of times of breakages of the bobbin being rewound at each unit is added and stored. On each winding unit is provided a lamp which is flickered in response to a signal from the controller 65 when the number of times of yarn breakages exceeds a predetermined number of times during winding of a bobbin.

In FIG. 13, the spinning frame 10 is applied with a discrimination symbol for specifying a spindle with respect to all spinning spindles, When doffing in the spinning frame, that is, a full spinning bobbin is replaced by an empty bobbin, spinning bobbins RB1, RB2, . . . RBn are placed on the transport band 53R in front of the spinning frame, and spinning bobbins RB1, RB2, . . . RBn are placed on the transport band 53L on the other side.

Under the aforementioned state, when a bobbin request signal is provided from a bobbin supply station 57 on the winder side to the spinning frame, bobbins, in order of the first bobbin RB1 of the transport band 53R on the R side, are successively supplied to standby empty trays. At that time, every time a bobbin is supplied from the spinning frame 10, spindle numbers RB1 to RBn of bobbins and the frame number are written by a write device 62. That is, at the write position, the tray 41 is rotated at constant speed in a direction indicated at 72 in FIG. 10. When, for example, the R side out of R and L sides is magnetized, in case of bobbin RB1, an R and L discrimination portion 50*a* of FIG. 10 is magnetized, and a discrimination symbol corresponding to the first spindle is magnetized at a portion of section S1 as shown in FIG. 14.

Figure 14:
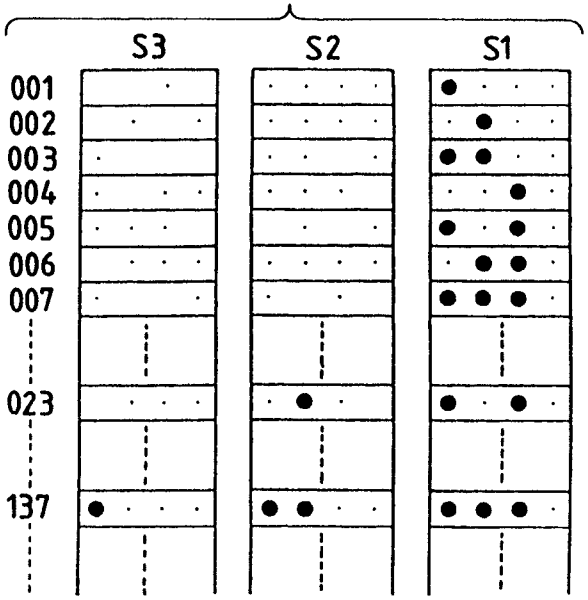
FIG. 14 is an explanatory view showing the relationship between the magnetized state of a rubber magnet sheet and the spinning frame.

Then, when the transport band is moved by one pitch to supply a bobbin of the second spinning frame onto the tray, the magnetized state corresponding to the spindle number 2 of FIG. 14 is written on the tray.

In this way, a spindle number plus 1 every time a bobbin is supplied is coded and written together with a frame number into the tray.

The spinning bobbin supported on the tray with the aforesaid frame number and spindle number written is transported in a direction of arrow on the carrying passage 59 via the yarn end preparation device 58 shown in FIG. 13. It is to be noted that as a winder in which a bobbin being mounted on the tray is supplied to a rewinding position, for example, the winder disclosed in Japanese Patent Application Laid-Open No. 57(1982)-170354 can be employed.

When a bobbin is supplied to a rewinding position and rewinding operation starts, the number of knottings is added in the controller 65. If the number of times of knottings per unit time (minute) of the bobbin exceeds a set value, judgement is made that too many yarn defects are present in the spinning bobbin, and winding-stop instructions are outputted to the unit and the lamp of the unit is flickered to notify it to an operator.

The operator removes from the tray the bobbin being rewound at the rewinding position of the winding unit for which the lamp flickers. When the rewinding start operation is again carried out, an empty tray is taken out of the unit and placed on the carrying passage 60 shown in FIG. 13 and carried in a direction of arrow.

When an empty tray with a bobbin not supported thereon arrives at a position of the read head 63, discrimination information on the tray is read, as shown in FIG. 12, to read a spindle number and transferred to the controller 65. The transferred data are collected in the controller 65 and further transferred to the main processor 15 so that a defective spindle number of the spinning frame can be known.

Of course, even in the read head position, the tray is fully rotated to read similar to the write position. It is noted that the tray and the write or read head may be relatively rotated, and the tray may be fixed in position and the head can be fully rotated.

The empty tray having passed through the read device 63 is transported to the bobbin supply position 57, and a new spinning bobbin is again received. A spinning spindle number for which the bobbin is produced is newly written, and the previously written spindle number is erased.

While in the above-described embodiment, a description has been made of a control system of a spinning frame in which a spinning spindle number is written on a rubber magnet sheet secured to a tray, it is to be noted that information for discriminating kinds of bobbins to be mounted on the rubber magnet sheet may be written.

Figure 15:
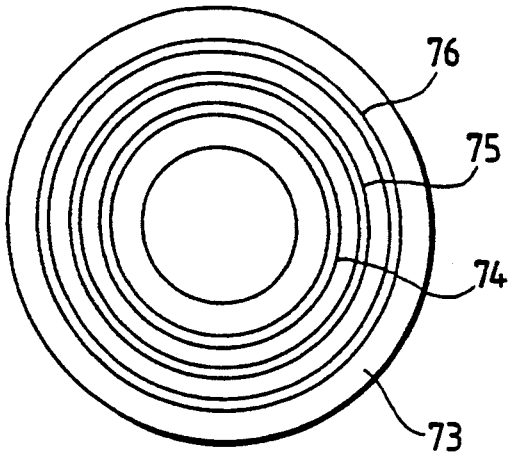
FIG. 15 is a plan view showing another embodiment of the tray.

For example, FIG. 15 shows an example in which three coaxial circular ring-like rubber magnets 74, 75 and 76 are secured to the upper surface of a tray 73. In this case, when a bobbin for yarn of kind A is mounted, only a ring 74 is magnetized; in case of kind B, only a central ring 75 is magnetized; and in case of kind C, only a ring 76 is magnetized to write kinds. A read head is provided in a branch path to a specific winding section on the winder side, and only the bobbin may be written into a predetermined wind-section.

Figure 16:
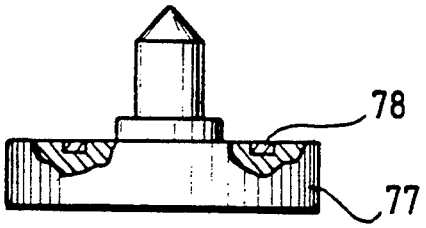
FIG. 16 is a plan view showing still another embodiment of the tray.

FIG. 16 shows a tray 77 with one rubber magnet ring 38 magnetized. Three kinds of bobbins can be discriminated according to the fact that N-pole is magnetized to the rubber magnet ring 78 or S-pole is magnetized or no magnetization is made. In this case, as a read head, a magnetic sensor capable of discriminating N and S can be employed.

According to the embodiments shown in FIGS. 10 to 16, there is provided a discrimination information display member capable of being written and erased in the bobbin carrying tray. Therefore, if discrimination information of a bobbin to be mounted is written, the tray itself is transported along with the bobbin. Thus, the pursue and control of bobbins can be simply carried out as compared with the case where a discrimination mark peculiar to the tray is applied to the tray.

As described above, according to a yarn quality control system in a spinning mill according to the present invention, when a product of poor quality is found, the cause when and where the problem occurred can be pursued backing to the processing steps, fiber machineries and spindles in the spinning mill.

What is claimed is:

1. In a material processing mill, a quality control system comprising:

a plurality of different processing machines for performing a plurality of different processing steps to produce a plurality of different intermediate products, each of the plurality of different processing machines having associated therewith production information, each of the plurality of different intermediate products having associated therewith quality information, at least one of the processing machines comprising a plurality of processing units for performing a processing step to produce a plurality of substantially similar intermediate products, each of the processing units having associated therewith production information, each of the intermediate products produced by the processing units having associated therewith quality information, a plurality of sub-processors, each of the plurality of sub-processors monitoring a corresponding one of the plurality of different processing machines, for determining the production information associated with the monitored processing machine and for determining the quality information associated with the intermediate product produced by the monitored processing machine, at least one of the sub-processors comprising means for monitoring the processing units to determine production information associated with the monitored processing units and to determine quality information associated with intermediate products produced by the monitored processing units, a main processor, and means for inputting the quality information and the production information from the plurality of sub-processors to the main processor.

2. The system of claim 1, further comprising:

means for transferring at least one of the intermediate products from one of the plurality of processing machines to another one of the plurality of processing machines at a place and at a time, wherein the at least one of the intermediate products has associated therewith record information identifying the place and the time at which the intermediate product is transferred, and wherein the main processor comprises means for collecting the record information identifying the place and the time at which the intermediate product is transferred from one of the plurality of processing machines to another one of the plurality of processing machines.

3. The system of claim 2, wherein at least one of the plurality of processing machines comprises a plurality of spindles, and further comprising means for transferring at least one of the intermediate products from one of the plurality of processing machines to one of the plurality of spindles, and wherein the record information identifies the processing machine from which the at least one of the intermediate products is transferred and identifies the spindle and the processing machine to which the at least one of the intermediate products is transferred.

4. The system of claim 2, wherein at least one of the plurality of processing machines comprises a plurality of spindles, and further comprising means for transferring at least one of the intermediate products from one of the plurality of spindles to one of the plurality of processing machines, and wherein the record information identifies the spindle and the processing machine from which the at least one of the intermediate products is transferred and identifies the processing machine to which the at least one of the intermediate products is transferred.

5. The system of claim 2, wherein at least one of the plurality of processing machines comprises a plurality of frames, and further comprising means for transferring at least one of the intermediate products from one of the plurality of processing machines to one of the plurality of frames, and wherein the record information identifies the processing machine from which the at least one of the intermediate products is transferred and identifies the frame and the processing machine to which the at least one of the intermediate products is transferred.

6. The system of claim 2, wherein at least one of the plurality of processing machines comprises a plurality of frames, and further comprising means for transferring at least one of the intermediate products from one of the plurality of frames to one of the plurality of processing machines, and wherein the record information identifies the frame and the processing machine from which the at least one of the intermediate products is transferred and identifies the processing machine to which the at least one of the intermediate products is transferred.

7. The system of claim 1 wherein at least one of the plurality of processing machines produces final products, and wherein the main processor comprises:

means for identifying and discriminating among the final products based upon quality information and production information associated with the final products, means for generating a record of the quality information and the production information associated with each of the final products, and means for labeling each of the final products with a label indicating that the record is available.

8. The system of claim 7, wherein the main processor comprises:

means for detecting a final product having a quality that is below a certain level, means for identifying the processing machine and the processing step which caused the quality of the final product to be below a certain level, and means for displaying the identified processing machine and the identified processing step.

* * * * *